US005153945A

United States Patent [19]

Kobayashi et al.

[11] Patent Number: 5,153,945

[45] Date of Patent: Oct. 13, 1992

[54] HEAD HOOD

[76] Inventors: Atsuko Kobayashi; Takeshi Ishikawa, both of 200 E. 82nd St., New York, N.Y. 10028

[21] Appl. No.: 741,334

[22] Filed: Aug. 7, 1991

[51] Int. Cl.[5] ..... A42B 3/04

[52] U.S. Cl. ..... 2/413; 2/172; 2/202; 2/204; 2/DIG. 10

[58] Field of Search ..... 2/171, 172, 184.5, 202, 2/203, 204, 205, 209.3, 209.5, 209.7, 410, 411, 412, 413, 423, DIG. 10

[56] References Cited

U.S. PATENT DOCUMENTS

| | | | |
|---|---|---|---|
| 600,778 | 3/1898 | Frazier | 2/413 |
| 1,221,473 | 4/1917 | Riley | 2/DIG. 10 |
| 1,398,165 | 11/1921 | Whiteside | 2/171 |
| 1,833,708 | 11/1931 | Ford | 2/413 |
| 2,121,702 | 6/1938 | Larkin | 2/413 |
| 2,618,780 | 11/1952 | Cushman | 2/413 |
| 2,632,176 | 3/1953 | Mitchell | 2/202 |
| 2,664,567 | 1/1954 | Nichols | 2/413 |
| 3,676,879 | 7/1972 | Irie | 2/202 |
| 3,951,160 | 4/1976 | Nitu | 2/410 |
| 4,274,161 | 6/1981 | Littler | 2/413 |
| 4,324,005 | 4/1982 | Willis | 2/413 |

FOREIGN PATENT DOCUMENTS

| | | | |
|---|---|---|---|
| 2717234 | 11/1978 | Fed. Rep. of Germany | 2/412 |
| 2394260 | 2/1979 | France | 2/DIG. 10 |
| 139164 | 4/1930 | Switzerland | 2/172 |
| 523530 | 7/1940 | United Kingdom | 2/204 |
| 824682 | 12/1959 | United Kingdom | 2/413 |
| 2133274 | 7/1984 | United Kingdom | 2/410 |

*Primary Examiner*—Werner H. Schroeder
*Assistant Examiner*—Diana L. Biefeld
*Attorney, Agent, or Firm*—Kanesaka and Takeuchi

[57] ABSTRACT

A head of a wearer is covered by a hood to protect the head from rain or snow. The hood comprises a hood body formed of an outer sheet and an inner sheet bonded together to form a space therebetween. When air is inflated into the space, the hood body enlarges to form a solid shape over the entire hood body. An edge portion is formed around a front opening of the hood body. The edge portion, in use, expands outwardly to allow water on the hood body to flow along the edge portion without crossing the front opening. At least one air passage device is attached to the hood body to allow air blown into the hood to pass or escape therethrough. When the air passage devices are formed near ears of the wearer, the air passage devices help audibility.

4 Claims, 1 Drawing Sheet

HEAD HOOD

BACKGROUND OF THE INVENTION AND RELATED ART STATEMENT

The present invention relates to a head hood, more particularly a hood for covering a head in rain.

A head hood and a raincoat with a head hood are popular in rainy and snowy days for protection from rain and snow. A head hood is generally folded when the head hood is not used. When the head hood is used, the head hood is unfolded and is put on a head of a wearer.

In regard to a head hood attached to a rain coat, the head hood is folded to retain in a collar or left on a back when it is not used. When the head hood is used, the head hood is put on a head of a wearer.

In either cases, when the head hood is put on a head of a wearer, the hood covers hair and cheeks. As a result, there arises some uncomfortable matters. For example, a style of hair is impaired, and audibility inside the hood goes wrong. Also, if it blows or wind enters into the head hood, the head hood is blown off. Moreover, water on the hood may drop across the face of the wearer.

In a conventional head hood, although the head of the wearer is protected from rain and snow, it is not comfortable to wear the hood and it causes hearing problem.

In U.S. Pat. 2,632,176, an inflatable head covering hood is disclosed, wherein the hood includes air tubes therein. When the air tubes are filled with air, the head hood is fully stretched or expanded to form a space for a head of a wearer.

In U.S. Pat. 3,676,879, an air tube is formed around a front opening of a hood to form a fixed shape.

In the prior patents, air tubes are attached to a hood to form fully stretched shape of the hood. However, the shape is not well maintained by the tube filled with air. Also, audibility and air passing or exhausting ability of the hood are not good.

Accordingly, one object of the present invention is to provide a head hood, which gently covers a head of a wearer with a stable form.

Another object of the invention is to provide a head hood as stated above, which is not substantially blown off by wind due to air passing or exhausting ability.

A further object of the invention is to provide a head hood as stated above, which does not substantially impair hair style and hearing problem.

A still further object of the invention is to provide a head hood as stated above, which is compact when folded and is readily expandable when used.

Further objects and advantages of the invention will be apparent from the following description of the invention.

SUMMARY OF THE INVENTION

In accordance with the present invention, a hood for covering a head of a wearer is provided to protect a head from rain or snow. The head hood may be formed integrally with or detachably from a raincoat.

The hood comprises a hood body for covering a head of the wearer and having front and bottom openings. The hood body is formed of an outer sheet and an inner sheet bonded together to form a space therebetween. When air is inflated into the space, the hood body stretches or enlarges to form a solid shape over the entire hood body.

When the hood is put onto a head, face and neck of the wearer are located behind the front opening and in the bottom opening, respectively. When the hood is used, the hood is at first put onto the head of the wearer. Thereafter, the space is filled with air, so that the hood is shaped into a stable or rigid form.

When air is inflated, an edge portion around the front opening of the hood body expands outwardly. Accordingly, water on the hood body generally flow along the edge portion without crossing the front opening.

The hood is further provided with at least one air passage device attached to the hood body. The air passage device allows air blown into the hood to pass therethrough. Preferably, two air passage devices are formed at portions near ears of the wearer. Accordingly, sound outside the hood is heard as well through the air passage devices.

When the hood is separately formed from the raincoat, the hood may be provided with a collar around the bottom opening to extend outwardly therefrom. Instead of the collar, a cape may be formed with the hood. As a result, rain or snow does not enter into an area around a neck of a wearer.

DETAILED DESCRIPTION OF PREFERRED EMBODIMENTS

Figure 1:
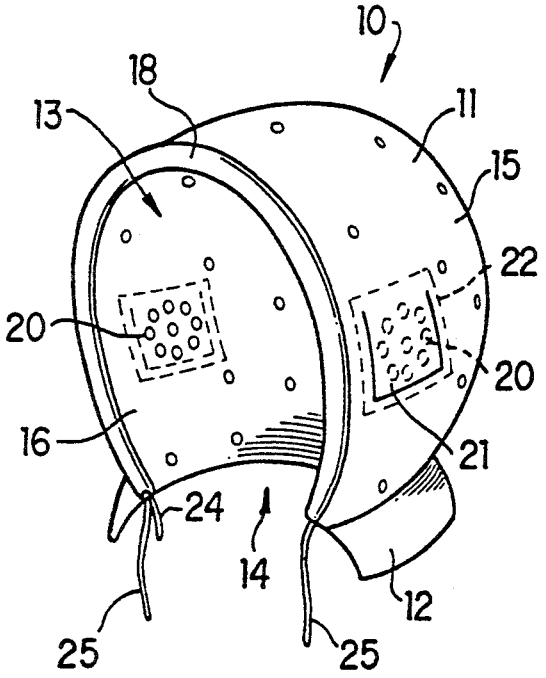
FIG. 1 is a perspective view of a head hood of the present invention.
Figure 2:
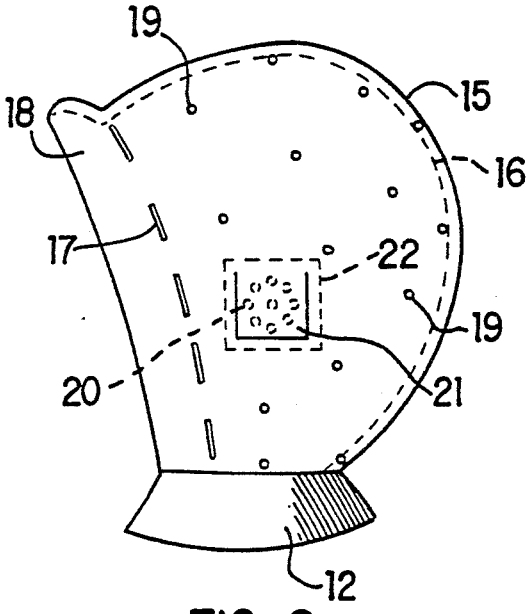
FIG. 2 is a side view of the head hood of FIG. 1.
Figure 3:
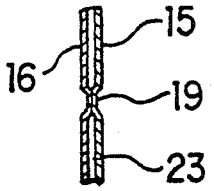
FIG. 3 is an explanatory section view for showing a connection of outer and inner sheets.

Referring to FIGS. 1–3, a head hood 10 of the present invention is shown. The hood 10 is designed to cover head and neck portions of a wearer.

The hood 10 is formed of a hood body 11 for covering a head of the wearer, and a collar 12 at a bottom of the hood body 10. The collar 12 covers a neck portion of the wearer. The hood body 11 is provided with a front opening 13 and a bottom opening 14. When the wearer puts the hood 10 on the head, a face is located behind the front opening 13, and a neck is located in the bottom opening 14.

The hood 10 is formed of an outer sheet 15 and an inner sheet 16, which are firmly connected together along outer peripheries thereof. A space 23 is formed between the outer and inner sheets 15, 16 to fill air therein. A mouth piece 24 with a valve (not shown) is connected to the inner sheet 15 to fill air inside the space 23.

Also, the outer and inner sheets 15, 16 are bonded together at 17 parallel to an edge portion 18 of the front opening 13. The edge portion 18 is formed to extend slightly outwardly from the front opening 13. Namely, a concaved or recessed line is formed at a portion spaced apart from the edge portion 18 along the bonded portions 17. When used, water on the hood flowing toward the front opening 13 is blocked by the edge portion 18 and flows downwardly along the bonded portions 17.

The outer and inner sheets 15, 16 are also bonded together at points 19 so that the outer and inner sheets 15, 16 do not move freely.

The inner sheet 16 is provided with a plurality of openings 20 at portions near ears of a wearer, while the outer sheet 15 is cut at three sides so that the outer sheet 15 provides flaps 21 outside the openings 20. The outer and inner sheets 15, 16 are firmly bonded together along a line 22 outside the openings 20 and the flaps 21. Therefore, air does not escape through the openings 20.

The flap 21 generally covers the opening 20, so that water does not enter from the openings 20. However, when wind blows and air enters inside the hood 10, air can ass through the openings 20 while pushing the flap 21 outwardly. The openings 20 and the flap 21 operate as a one-way air passage.

Also, since the openings 20 and the flaps 21 are located near ears of the wearer, sound outside the hood 10 is heard through the openings 20 and the flaps 21. Therefore, the openings 20 and the flaps 21 operate as a hearing aid.

The hood 10 is also provided with strings 25 to tighten the hood around the neck portion. A hook or other device may be used to tighten together at the neck portion.

When the hood 10 is used, the wearer puts the hood 10 on the head, and then fills air into the space 23 through the mouthpiece 24. As a result, the hood 10 enlarges or stretches as a whole. After use, the hood 10 is taken out of the head of the wearer, and then the valve at the mouthpiece 23 is pushed to remove air from the space 23. The hood 10 is then folded.

In the present invention, when the hood 10 is not used, the hood 10 can be folded into a small size. Therefore, it is easy to carry the hood 10.

When the hood 10 is used, the hood is put onto a head and air is filled into the space 23. Therefore, it is easy to wear and use. When air is filled in the space 23, the hood 10 is shaped into a complete three dimensional form as a whole. Therefore, in case the hood 10 is put on a head, hair style is not impaired.

Also, the hood 10 is provided with the openings 20 and the flaps 21. Therefore, even if wind blows and air enters into the hood 10, air passes through the openings 20. The hood is not blown off by wind, and sound outside the hood can be heard through the openings 20.

Further, since a space is formed between the hood and the head, sight and audibility of the wearer are improved as well. Moreover, since the edge portion 18 projects outwardly, rain drops or water on the hood do not substantially drop across the front opening 13.

Figure 4:
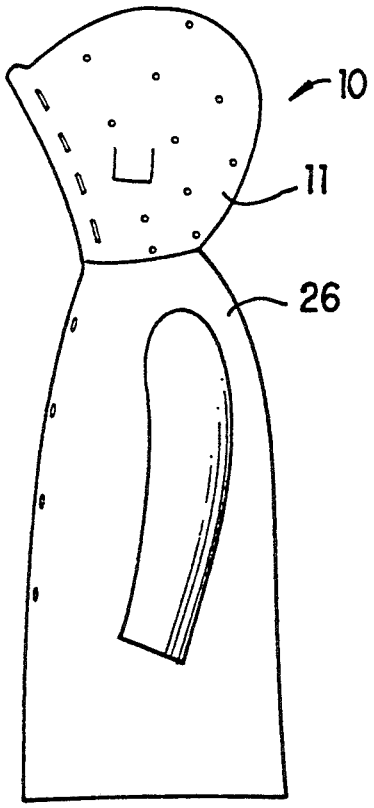
FIG. 4 is a side view of a different embodiment, wherein a head hood of the invention is combined with a raincoat.

FIG. 4 shows a combination of the hood 10 and a raincoat 26 integrally formed together. In particular, the hood 10 is provided with a hood body 11, which is connected to a collar portion of the raincoat 26.

If the hood 10 is not used, the hood is left behind a back of the rain coat 26. When the hood 10 is used, the hood 10 is put on the head of the wearer, and the space 23 is filled with air.

In the hood of the present invention, the hood is preferably made of a transparent material, such as a vinyl sheet, so that visibility is improved. However, the hood can be made of any material.

In accordance with the present invention, the hood is properly enlarged by filling air inside the space, and the hood can be folded when it is not used. Therefore, the hood is very convenient to carry.

Also, when the space is filled with air, the hood enlarges to keep the shape properly. Therefore, the hood does not substantially bother the wearer.

While the invention has been explained with reference to the specific embodiments of the invention, the explanation is illustrative and the invention is limited only by the appended claims.

What is claimed is:

1. A hood adapted for covering a head of a wearer, comprising:

a hood body for covering a head of a wearer and having front and bottom openings, said front and bottom openings being arranged such that a face of the wearer is located behind the front opening and the bottom opening is situated around a neck of the wearer when the hood is worn, said hood body including a main outer surface, an outer sheet for forming the main outer surface, and an inner sheet bonded to the outer sheet to form a space therebetween so that when the space is filled with air, the hood body enlarges to form a solid shape substantially over the entire hood body, an edge portion formed around the front opening of the hood body, said edge portion expanding radially outwardly over the main outer surface of the hood body relative to a center of the front opening to allow water on the main outer surface of the hood body to flow along the edge portion without crossing the front opening, and two air passage devices formed in the hood body at portions near ears of the wearer to allow air blown into the hood to pass therethrough and to help hearing of sound outside the hood, each air passage device including a plurality of small holes formed in the inner sheet, a flap formed in the outer sheet and located outside the small holes to cover the entire small holes to prevent water from flowing into an inside of the hood body through the small holes, said flap being formed of a part of the outer sheet and defined by two side edges and a bottom edge to orient toward the bottom opening, and a seal line for airtightly bonding the outer and inner sheets together outside the small holes and the flap so that air passes through the small holes from the inside of the hood body, and water is prevented from entering into the inside of the hood body through the small holes by the flap while facilitating hearing of sound outside the hood.

2. A hood according to claim 1, wherein said inner and outer sheets include bonded portions to define the edge portion.

3. A hood according to claim 1, further comprising a collar attached around the bottom opening to extend outwardly therefrom.

4. A hood according to claim 1, further comprising a rain coat integrally formed around the bottom opening.

* * * * *